United States Patent [19]

deGraft-Johnson et al.

[11] Patent Number: 4,869,991

[45] Date of Patent: Sep. 26, 1989

[54] CHARGE DIRECTOR COMPOSITION FOR LIQUID TONER FORMULATIONS

[75] Inventors: Joseph deGraft-Johnson, Piscataway; Chi Ma, Morris Plains; Richard R. L. Wells, Glenwood, all of N.J.

[73] Assignee: Olin Hunt Specialty Products Inc., West Paterson, N.J.

[21] Appl. No.: 252,339

[22] Filed: Oct. 3, 1988

Related U.S. Application Data

[63] Continuation-in-part of Ser. No. 172,448, Mar. 24, 1988, abandoned.

[51] Int. Cl.[4] ..... G03G 9/16

[52] U.S. Cl. ..... 430/115; 430/104; 430/105; 430/112

[58] Field of Search ..... 430/115, 104, 105, 112, 430/110; 524/106, 327, 328

[56] References Cited

U.S. PATENT DOCUMENTS

| | | | |
|---|---|---|---|
| 3,210,169 | 10/1965 | van der Minne et al. | 44/62 |
| 3,380,970 | 4/1968 | van der Minne et al. | 260/78.4 |
| 3,397,971 | 8/1968 | van der Minne et al. | 44/68 |
| 3,542,682 | 11/1970 | Mutaffis | 252/62.1 |
| 3,669,886 | 6/1972 | Kosel | 252/62.1 |
| 3,753,760 | 8/1973 | Kosel | 117/37 LE |
| 3,900,412 | 8/1975 | Kosel | 252/62.1 |
| 3,939,087 | 2/1976 | Vijayendran et al. | 252/61.1 L |
| 3,990,980 | 11/1976 | Kosel | 252/62.1 L |
| 3,991,226 | 11/1976 | Kosel | 427/17 |
| 4,476,210 | 10/1984 | Croucher et al. | 430/114 |
| 4,618,557 | 10/1986 | Dan et al. | 430/114 |
| 4,636,452 | 1/1987 | Furukawa et al. | 430/112 |

FOREIGN PATENT DOCUMENTS 2460763 7/1976 Fed. Rep. of Germany .

463716 1/1971 Japan .

OTHER PUBLICATIONS

Shell Oil Corporation Product Brochure for ASA-3 Antistatic Additive for Liquid Hydrocarbons (printed 1983).

Croucher et al, "Colloidal and Transport Properties of Electrostatically Based Liquid Developers", Photographic Science and Engineering, vol. 28, Nov. 3, May/Jun. 1984.

*Primary Examiner*—Paul R. Michl
*Assistant Examiner*—Jeffrey A. Lindeman
*Attorney, Agent, or Firm*—W. A. Simons

[57] ABSTRACT

A charge director composition dispersed in at least one solvent comprising:

A. a salt mixture comprised of 1–10 parts by weight each of:
   (i) a chromium salt of a $C_{14-18}$ alkyl salicylic acid;
   (ii) a calcium didecyl sulfosuccinate; and
   (iii) a salt of the didecyl ester of sulfosuccinate acid and at least 50% of the basic nitrogen radicals of a copolymer of lauryl methacrylate, stearyl methacrylate and 2-methyl-5-vinyl pyridine, said copolymer having a vinyl pyridine content of 20–30% by weight and an average molecular weight of 15,000–250,000; and B. a salt-free copolymer of (i) laurylmethacrylate and (ii) a monomer selected from 2- or 4-vinylpyridine, styrene and N,N-dimethylaminoethylmethacrylate and mixtures thereof, said copolymer having a molecular weight from about 15,000 to about 100,000, and the weight ratio of monomers B(i) to B(ii) is from about 4:1 to about 50:1; and wherein the weight ratio of B:A is from 10:3 to about 40:3.

6 Claims, No Drawings

CHARGE DIRECTOR COMPOSITION FOR LIQUID TONER FORMULATIONS

RELATED APPLICATIONS

This application is a continuation-in-part of application Ser. No. 172,448, filed Mar. 24, 1988 now abandoned.

BACKGROUND OF THE INVENTION

1. Field of the Invention

The present invention relates to a charge director composition for liquid toner formulations.

2. Description of the Prior Art

Liquid toner compositions are used in office copy machines, computer print-out devices, lithographic master preparation and the like to create a visible counterpart from a latent electrostatic image. Liquid toners generally consist of five components: a carrier liquid, coloring agent, fixative agent, dispersing agent and charge director. In any given toner composition, thre may be one or more of each of these components. Also, one or more chemicals in such toner compositions may simultaneously have multiple functions. For example, a dispersing agent may also act as a fixative. Moreover, when a polymeric dispersing agent is employed, the combination of coloring agent, fixing agent and dispersing agent is sometimes called a dyed latex solid toner polymer.

A carrier liquid component for a liquid toner composition must have a low specific conductivity (e.g. resistivity of greater than $10^{10}$ ohms cm), a low dielectric constant (e.g. less than 3.5), a low viscosity and a rapid evaporation rate. Furthermore, such a carrier liquid should also preferably have low toxicity, low cost, poor solvent power, no odors, chemical stability and a high flash point. With all of these restrictions together, the preferred choice is an aliphatic hydrocarbons, most preferably an odorless mineral spirit in the TCC flash point range of 101° to 150° F. Isopar G or H solvents made by Exxon Corporation are typical of particularly preferred aliphatic hydrocarbons.

In the development of the electrostatic latent image to a visible image, the coloring agent or solid particles (including dyes or pigments) in the toner composition either migrate to the charged areas or the uncharged areas but not to both. If the coloring agent or solid particles go to the charged areas, this is called positive development. If the particles go to the uncharged areas, this is called reversal development. The coloring agent should be essentially insoluble in the carrier liquid and preferably contain no contaminants which are soluble therein. Dyes are selected from their solubility in the fixing agent and insolubility in the carrier liquid as well as their color. Moreover, pigments are chosen on the basis of proper color, the best intrinsic surface or migration properties, the ease of grinding the coloring agent to a desired fine particle size, and the smallest differential between the specific gravities of the pigment and the carrier liquid. Both dyes and pigments should preferably be chemically stable and light-fast.

In order to create a stable dispersion of the pigment particles in the liquid carrier, a dispersing agent is normally used. Generally, this stable dispersion is made by grinding a slurry of the pigment particles in the carrier liquid in the presence of a sufficient amount of the dispersing agent or agents. Most commercial dispersing agents are surface-active molecules (i.e. they possess a polar end and a non-polar end). It is believed that the polar end part of the molecule is absorbed on the surface of the pigment molecule while the non-polar end is oriented away from that particular surface into the surrounding liquid carrier phase. Thus, a dispersing agent is preferably chemically stable, soluble in the liquid carrier continuous phase and absorbable by the pigment particles.

In contrast, dyes are usually employed in dyed latex solid toner polymers. Accordingly, the dyes are incorporated therein by reacting them into the polymer or by dissolving them into a swelled solid latex polymer particle.

The fixative agent aids in the making of the toned or visual image a permanent part of the underlying substrate (e.g. paper). These fixative agents are generally natural resins or synthetic polymers which have the desirable characteristics of chemical stability, an unobjectable color, and may be preferably insoluble in the liquid carrier as well as be compatible with a substrate onto which the image is deposited. There are many commercially available resins useful for this purpose.

The last component of a liquid toner is the charge director. The charge directors must be soluble or dispersible in the hydrocarbon liquid carrier and must create or augment an electrostatic charge on micron or sub-micron fixative agent particles. The patent literature is replete with different charge director compositions. The majority are metal salts of long chain fatty acids, both substituted and unsubstituted.

In U.S. Pat. Nos. 3,753,760; 3,900,412; 3,990,980; and 3,991,266, all of which issued to Kosel and are each incorporated herein by reference in their entirety, teach the creation of a multi-functional amphipathic or latex molecule which combines in one molecule the functions of colorant agent, the dispersing agent, and the fixative agent. Thus, liquid latex toners as these are sometimes called, have only three components: the carrier liquid, the multi-functional latex particle and the charge director.

One known commerically used charged director is ASA-3 antistatic additive for liquid hydrocarbons. This additive is comprised of 1–10 parts each of:

1. a chromium salt of a $C_{14-18}$ alkyl salicyclic acid;
2. a calcium didecyl sulfosuccinate; and
3. a salt of the didecyl ester of sulfosuccinate acid and at least 50% of the basic nitrogen radicals of a copolymer of lauryl methacrylate, stearyl methacrylate and 2-methyl-5-vinyl pyridine (also called 5-vinyl-2-picoline) said copolymer having a vinyl pyridine content of 20–30% by weight and an average molecular weight of 15,000–250,000.

A preparation of this additive is shown in U.S. Pat. Nos. 3,210,169 and 3,380,970 (both assigned to Shell Oil Co.), both of which are incorporated herein by reference in their entireties.

This ASA-3 charge director has worked very effectively in many latex-based liquid toner compositions. However, liquid toner formulations containing this charge director composition do suffer from a gradual increase of resistivity (i.e. loss of conductance) over a period of time. This resistivity increase is a serious problem when quantities of the liquid toner containing this charge director must be stored for long periods of time, causing possible functional problems with plate or print quality.

Accordingly, there is a need in this art to improve the conductance stability of liquid toners employing ASA-3 as a charge director without adversely effecting the other desired properties of the toner formulation. The present invention is a solution to this need.

BRIEF SUMMARY OF THE INVENTION

The present invention, therefore, is directed to a charge director composition dispersed in a solvent which comprises:

A. a salt mixture comprised of 1–10 parts by weight each of:

(i) a chromium salt of a $C_{14-18}$ alkyl salicylic acid;

(ii) a calcium didecyl sulfosuccinate; and (iii) a salt of the didecyl ester of sulfosuccinate acid and at least 50% of the basic nitrogen radicals of a copolymer of lauryl methacrylate, stearyl methacrylate and 2-methyl-5-vinyl pyridine, said copolymer having a vinyl pyridine content of 20–30% by weight and an average molecular weight of 15,000–250,000; and B. a salt-free copolymer of (i) laurylmethacrylate and (ii) a monomer selected from 2- or 4-vinylpyridine, styrene and N,N-dimethylaminoethylmethacrylate and mixtures thereof, said copolymer having a molecular weight from about 15,000 to about 100,000, and the weight ratio of monomers B(i) to B(ii) is from about 4:1 to 50:1, and wherein the weight ratio of B:A is from about 10:3 to about 40:3.

DETAILED DESCRIPTION

The preferred solvent dispersed charge director composition of the present invention has three components. The first component (Component A) is the salt mixture as defined above. The preferred example of Component A is the commercially available ASA-3 antistatic additive for liquid hydrocarbons made by Royal Dutch Shell and distributed in the United States by Royal Lubricant (a subsidiary of Royal Dutch Shell) located in Roseland, New Jersey. The preparation of this component is described in the above-noted U.S. patents assigned to Shell Oil Company.

Analytical techniques are presently unable to exactly describe what ASA-3 is made up of. From the analytical results carried out with this salt mixture, it is believed that the preparation shown in Example 1 of the above-noted Shell Oil patents, utilizing either the listed Salt 5 or Salt 8, best represent the preparation of ASA-3.

This salt mixture may be preferably dispersed in an aromatic hydrocarbon solvent such as xylene or toluene. The presence of this aromatic solvent is not critical to the present invention, but aids in the solubilization of the metal salts of Component A in the aliphatic hydrocarbon solvent described below. It is noted that the ASA-3 salt mixture is dissolved in xylene.

The second component (Component B) is a copolymer of laurylmethacrylate with a monomer selected from the group of 2- or 4-vinylpyridine or styrene or N,N-dimethylaminoethylmethacrylate or mixtures thereof. The presence of copolymer has unexpectedly increased the conductance stability of the first ingredient (A). 4-Vinylpyridine is the preferred co-monomer. The preferred molecular weight of this copolymer is about 20,000 to about 60,000; more preferably, from about 30,000 to about 40,000. Molecular weights are measured by Gel Permeation Chromatography. The preferred ratio of the laurylmethacrylate to the second monomer is from about 9:1 to about 39:1.

The third component (Component C) of this preferred solvent dispersed charge director composition is an aliphatic hydrocarbon solvent, preferably one which is a mixture of alkyls having about 6 to 30, more preferably, a mixture of alkyls about 8 to about 20 carbon atoms. Isopar G or H are preferred; Isopar G is is the most preferred aliphatic hydrocarbon solvent.

The preferred and more preferred ranges and most preferred percentages for each of these three components is given as follows:

| Component | Preferred Range | More Preferred Range | Most Preferred Percentage |
|---|---|---|---|
| A | 0.1–1.5% | 0.35–0.55% | 0.45% |
| B | 0.35–10% | 1–7% | 3% |
| C | Balance | Balance | 96.55% |

These three components may be mixed together to form a liquid charge director solution. They may then be added to a conventional liquid toner composition. The amount of the above preferred three component charge director composition is preferably about 0.5% to about 6.0% by weight of the liquid toner formulation.

The following Examples and Comparison further illustrate the present invention. All parts and percentages are by weight unless explicitly stated otherwise.

EXAMPLES 1–3 AND COMPARISON 1

Four charge director solutions were prepared. The ingredients for each of these four solutions are shown below in Examples 1–3 and Comparison 1.

EXAMPLE 1

| Ingredient | Parts by Weight |
|---|---|
| ASA-3 antistatic additive | 0.45 |
| Copolymer of 95 parts by weight laurylmethacrylate/5 parts by weight of 4-vinylpyridine having a molecular weight of about 34,000 ± 3,400 (G.P.C.) | 3.00 |
| Isopar G | 96.55 |
| | 100.00 |

EXAMPLE 2

| Ingredient | Parts by Weight |
|---|---|
| ASA-3 antistatic additive | 0.45 |
| Copolymer of 90 parts by weight laurylmethacrylate/10 parts by weight of styrene having a molecular weight of 34,000 ± 3,400 (G.P.C.) | 3.00 |
| Isopar G | 96.55 |
| | 100.00 |

EXAMPLE 3

| Ingredient | Parts by Weight |
|---|---|
| ASA-3 antistatic additive | 0.45 |
| Copolymer of 90 parts by weight laurylmethacrylate/10 parts by weight of N,N—dimethylaminoethylmethacrylate having a molecular weight of 30,000 to 40,000 (G.P.C.) | 3.00 |

-continued

| Ingredient | Parts by Weight |
|---|---|
| Isopar G | 96.55 |
| | 100.00 |

COMPARISON 1

| Ingredient | Parts by Weight |
|---|---|
| ASA-3 antistatic additive | 0.50 |
| Isopar G | 99.50 |
| | 100.00 |

All four charge director solutions were added to one or more different conventional liquid toner compositions each containing toner dispersant (Isopar G) and dyed latex solid toner polymer (1% by weight solids in Isopar G) prepared according to the teachings in U.S. Pat. Nos. 3,753,760; 3,900,412; 3,900,980 and 3,991,266 previously mentioned.

These percentages of ingredients for these ten resultant products are shown in Table I below.

PREPARATION OF LIQUID TONER

Into a 6000 ml beaker was added the required amount of Isopar G. The dyed latex polymer was added to the beaker with gradual stirring. Each charge director solution of Examples 1–3 and Comparison 1 was solution was added last. Each toner was stirred for an hour before resistivity measurements were taken. A 100 cc toner sample was withdrawn for resistivity measurements. The exact percentages of these three liquid toner components are shown in Table I.

RESISTIVITY MEASUREMENTS

A 100 cc sample of each liquid toner solution was poured into a conductance test tube and a Balsbaugh cell placed in each test tube and the resistivity was measured by a Capacitance Bridge apparatus manufactured by General Radio Co. of Concord, Massachusetts (Model Type 1615-A). The test was repeated on the first, second, seventh, fourteenth and thirty-fifth day after the initial toner solution preparation. The prepared toners were kept at room temperature during the test period. The results of these resistivity measurements (in Ohm-cm$\times 10^{12}$) are shown in Table I. As can be seen, the liquid toner compositions containing the Comparison 1 charge director showed a significant increase in resistivity over time for two of the three levels of resistivity measured. In comparison, the liqud toner composition containing the charge director of Example 1 showed no significant increase of resistivity over time for all three resistivity levels. The liquid toner composition containing the charge director of Example 2 also showed no significant increase over all three levels. The liquid toner composition of Example 3 showed no significant increase in resistivity over time for the single level measured. Therefore, this comparison shows that the charge directors of the present invention as illustrated by Examples 1, 2 and 3 gave various liquid toner compositions and better conductance stability than the same liquid toner compositions having conventional charge directors therein as illustrated by Comparison 1.

ELECTROSTATIC OFFSET LITHOGRAPHY VISUAL OBSERVATIONS

In addition, electrostatic offset lithography press copies were prepared from a zinc oxide coated lithographic plate having a resinous binder coating. This coating had the desired photoconductive properties for the development of a latent electrostatic image. When this latent image was individually developed with the nine liquid toners containing charge directors of Example 1, Example 2 or Comparison 1 (after these toner compositions have been left standing at room temperature for 35 days), the image areas on the lithographic plate became ink receptive. The liquid toner containing the charge director of Example 3 was not visual tested in this evaluation. The surface of zinc oxide lithographic plate were then treated with an etch solution containing ammonium, potassium and ferrocyanide salts to convert the non-imaged portions of the zinc oxide lithographic plate from a hydrophobic surface to a hydrophilic one. This was done to enable the imaged plate to accept the ink in only those toned areas during the production of multiple impressions (i.e. about 1000 impressions for each toner) on an offset press. Visual inspection of the multiple impressions made with each toner are recited in Table II. Ghosting is the unintended transfer of residual toner from one copy to another usually resembling the image of a previous copy. Solid fill is the ability to reproduce large solid areas with a uniform large density. Tailing is a fringe effect appearing on the trailing edge of the toned electrostatic image which may or may not print. The levels of ghosting, solid fill and tailing were measured according to the following objective measurement scheme:

| Ghosting Measurement | Solid Fill Measurement |
|---|---|
| no ghosting = 1 | good solid fill = 1 |
| slight ghosting = 2 | partial solid fill = 2 |
| medium ghosting = 3 | no solid fill = 3 |
| heavy ghosting = 4 | |
| **Tailing Measurement** | |
| no tailing = 1 | |
| slight tailing = 2 | |
| heavy tailing = 3 | |

As can be seen from Table II, the printed impressions developed with toners containing the charge director of Comparison 1 showed undesirable ghosting, solid fill and tailing. In comparison, the printed impressions developed with toners containing the charge directors of Examples 1 and 2 showed no undesirable impression characteristics. Therefore, the charge directors of the present invention as illustrated by Examples 1 and 2 allow for better image processing after time than toner systems containing conventional charge directors illustrated by Comparison 1.

TABLE I

| | Resistivity Measurement | | | | | | | | | |
|---|---|---|---|---|---|---|---|---|---|---|
| | Product 1 | Product 2 | Product 3 | Product 4 | Product 5 | Product 6 | Product 7 | Product 8 | Product 9 | Product 10 |
| Example 1 | | 5.54% | | | 0.76% | | | 0.96% | | |
| Example 2 | | | 5.54% | | | 0.76% | | | 0.96% | |
| Example 3 | | | | | | | | | | 0.93% |

TABLE I-continued

| | Resistivity Measurement | | | | | | | | | |
|---|---|---|---|---|---|---|---|---|---|---|
| | Product 1 | Product 2 | Product 3 | Product 4 | Product 5 | Product 6 | Product 7 | Product 8 | Product 9 | Product 10 |
| Comparison 1 | 5.57% | | | 0.76% | | | 0.96% | | | |
| Dispersant | 91.66% | 91.66% | 91.66% | 96.51% | 96.51% | 96.51% | 96.03% | 96.03% | 96.03% | 95.57% |
| Dyed Latex | 2.77% | 2.80% | 2.80% | 2.73% | 2.73% | 2.73% | 3.01% | 3.01% | 3.01% | 3.50% |
| Resistivity Level (Ohm-cm $\times 10^{12}$) | | | | | | | | | | |
| Day 0 | 0.103 | 0.103 | 0.94 | 0.656 | 0.646 | 0.636 | 1.370 | 1.296 | 1.277 | 0.477 |
| 2 | 0.125 | 0.105 | 0.96 | 0.844 | 0.683 | 0.676 | 1.436 | 1.346 | 1.379 | 0.491 |
| 7 | 0.137 | 0.100 | 0.96 | 0.817 | 0.659 | 0.663 | 1.522 | 1.308 | 1.379 | 0.504 |
| 14 | 0.143 | 0.101 | 0.95 | 0.877 | 0.687 | 0.676 | 1.665 | 1.425 | 1.436 | 0.500 |
| 35 | 0.151 | 0.102 | 0.93 | 0.877 | 0.680 | 0.663 | 1.546 | 1.347 | 1.448 | N.M. |

N.M. = not measured

TABLE II

| | | Visual Observations | | |
|---|---|---|---|---|
| | | Range of Impressions Observed | | |
| Product | Observation | 1-100 | 101-500 | 501-1000 |
| 1 | ghosting | 3 | 4 | 4 |
| | solid fill | 2 | 2 | 3 |
| | tailing | 2 | 3 | 3 |
| 2 | ghosting | 1 | 1 | 1 |
| | solid fill | 1 | 1 | 1 |
| | tailing | 1 | 1 | 1 |
| 3 | ghosting | 1 | 1 | 1 |
| | solid fill | 1 | 1 | 1 |
| | tailing | 1 | 1 | 1 |
| 4 | ghosting | 4 | 4 | 4 |
| | solid fill | 3 | 3 | 3 |
| | tailing | 2 | 3 | 3 |
| 5 | ghosting | 1 | 1 | 1 |
| | solid fill | 1 | 1 | 1 |
| | tailing | 1 | 1 | 1 |
| 6 | ghosting | 1 | 1 | 1 |
| | solid fill | 1 | 1 | 1 |
| | tailing | 1 | 1 | 1 |
| 7 | ghosting | 4 | 4 | 4 |
| | solid fill | 3 | 3 | 3 |
| | tailing | 2 | 3 | 3 |
| 8 | ghosting | 1 | 1 | 1 |
| | solid fill | 1 | 1 | 1 |
| | tailing | 1 | 1 | 1 |
| 9 | ghosting | 1 | 1 | 1 |
| | solid fill | 1 | 1 | 1 |
| | tailing | 1 | 1 | 1 |

What is claimed is:

1. A charge director composition "useful in electrostatic toner formulations" dispersed in at least one solvent comprising:

A. a salt mixture comprised of 1-10 parts by weight each of:

(i) a chromium salt of a $C_{14-18}$ alkyl salicylic acid;

(ii) a calcium didecyl sulfosuccinate; and (iii) a salt of the didecyl ester of sulfosuccinate acid and at least 50% of the basic nitrogen radicals of a copolymer or lauryl methacrylate, stearyl methacrylate and 2-methyl-5-vinyl pyridine, said copolymer having a vinyl pyridine content of 20-30% by weight and an average molecular weight of 15,000-250,000; and B. a salt-free copolymer of (i) laurylmethacrylate and (ii) a monomer selected from 2- or 4-vinylpyridine, styrene and N,N-dimethylaminoethylmethacrylate and mixtures thereof, said copolymer having a molecular weight from about 15,000 to about 100,000, and the weight ratio of monomers B(i) to B(ii) is from about 4:1 to about 50:1; wherein the weight ratio of B:A is from 10:3 to about 40:3.

2. The charge director composition of claim 1 wherein said solvent in which the charge director composition is dispersed comprises (C) an aliphatic hydrocarbon solvent having about 6 to about 30 carbon atoms.

3. The charge director composition of claim 2 wherein (C) is an aliphatic hydrocarbon solvent having from about 8 to 20 carbon atoms.

4. The charge director composition of claim 3 wherein said components A-C are present in the following weight percentages:

A. about 0.15 to about 1.5%;

B. about 0.35% to about 10%; and

C. balance.

5. A solvent dispersed charge director composition "use in electrostatic toner formulations" comprising:

A. about 0.35% to about 0.45% by weight of a salt mixture comprised of 1-10 parts by weight each of:

(i) a chromium salt of a $C_{14-18}$ alkyl salicylic acid;

(ii) a calcium didecyl sulfosuccinate; and (iii) a salt of the didecyl ester of sulfosuccinate acid and at least 50% of the basic nitrogen radicals of a copolymer of lauryl methacrylate, stearly methacrylate and 2-methyl-5-vinyl pyridine, said copolymer having a vinyl pyridine content of 20-30% by weight and an average molecular weight of 15,000-250,000;

B. about 1% to about 7% by weight of a copolymer of (i) laurylmethacrylate and (ii) a monomer selected from 2- or 4-vinylpyridine, styrene and N,N-dimethylaminoethylmethacrylate and mixtures thereof, said copolymer having a molecular weight from about 20,000 to about 60,000 and a weight ratio of monomers B(i) to B(ii) is from about 9:1 to about 39:1; and C. balance in percent by weight of an aliphatic hydrocarbon solvent having a mixture of alkyl groups having about 8 to about 20 carbon atoms; and wherein the weight ratio of B:A is from 10:3 to 40:3.

6. A solvent dispersed charge director composition "useful in electrostatic toner formulations" consisting of:

A. about 0.045% by weight of a salt mixture comprised of 1-10 parts by weight each of:

(i) a chromium salt of a $C_{14-18}$ alkyl salicylic acid;

(ii) a calcium didecyl sulfosuccinate; and (iii) a salt of the didecyl ester of sulfosuccinate acid and at least 50% of the basic nitrogen radicals of a copolymer of lauryl methacrylate, stearyl methacrylate and 2-methyl-5-vinyl pyridine, said copolymer having a vinyl pyridine content of 20-30% by weight and an average molecular weight of 15,000-250,000;

B. about 3% by weight of a copolymer of (i) laurylmethacrylate and (ii) 4-vinylpyridine, said copolymer having a molecular weight of about 30,000 to about 40,000 and the weight ratio of monomers B(i):B(ii) is about 19:1; and C. about 96.55% by weight of "aliphatic hydrocarbon solvent".

* * * * *

UNITED STATES PATENT AND TRADEMARK OFFICE

CERTIFICATE OF CORRECTION

PATENT NO. : 4,869,991

DATED : September 26, 1989

INVENTOR(S) : Joseph deGraft-Johnson et al.

It is certified that error appears in the above-identified patent and that said Letters Patent is hereby corrected as shown below:

At column 2, line 47; delete "sulfosuccinate acid" and insert instead --sulfosuccinic acid--.

At column 3, line 15; delete "sulfosuccinate acid" and insert instead --sulfosuccinic acid--.

At column 7, lines 43-44; delete ""useful in electrostatic toner formulations"" and insert instead --useful in electrostatic toner formulations--.

At column 7, Claim 1, line 50; delete "sulfosuccinate acid" and insert instead --sulfosuccinic acid--.

At column 8, line 24; delete ""use in electrostatic toner formulations"" and insert instead --useful in electrostatic toner formulations--.

At column 8, line 28; delete "sulfosuccinate acid" and insert instead --sulfosuccinic acid--.

At column 8, line 49; delete ""useful in electrostatic toner formulations"" and insert instead --useful in electrostatic toner formulations--.

At column 8, line 55; delete "sulfosuccinate acid" and insert instead --sulfosuccinic acid--.

UNITED STATES PATENT AND TRADEMARK OFFICE

CERTIFICATE OF CORRECTION

PATENT NO. : 4,869,991

DATED : September 26, 1989

INVENTOR(S) : Joseph deGraft-Johnson et al.

It is certified that error appears in the above-identified patent and that said Letters Patent is hereby corrected as shown below:

At column 8, lines 67 and 68; delete ""aliphatic hydrocarbon solvent"" and insert instead --aliphatic hydrocarbon solvent--.

Signed and Sealed this

Twenty-fourth Day of July, 1990

*Attest:*

HARRY F. MANBECK, JR.

*Attesting Officer*

*Commissioner of Patents and Trademarks*